US007394212B2

(12) United States Patent
Wey et al.

(10) Patent No.: US 7,394,212 B2
(45) Date of Patent: Jul. 1, 2008

(54) INVERTER AND INVERTER UNIT THEREOF

(75) Inventors: Chin-Der Wey, Miaoli County (TW); Tsung-Shiun Lee, Hsin-Chu (TW); Hung-Chih Lin, Hsin-Chu (TW); Wei-Chung Chuang, Hsin-Chu (TW)

(73) Assignee: Au Optronics Corp., Hsin-Chu (TW)

( * ) Notice: Subject to any disclaimer, the term of this patent is extended or adjusted under 35 U.S.C. 154(b) by 0 days.

(21) Appl. No.: 11/723,271

(22) Filed: Mar. 19, 2007

(65) Prior Publication Data

US 2008/0042589 A1 Feb. 21, 2008

(30) Foreign Application Priority Data

Aug. 15, 2006 (TW) ..... 95129993 A

(51) Int. Cl.
*G05F 1/00* (2006.01)

(52) U.S. Cl. ..... 315/291; 315/307; 315/224; 315/225; 315/312

(58) Field of Classification Search ..... 315/224, 315/225, 247, 246, 274–289, 291, 307, 297, 315/312, 324

See application file for complete search history.

(56) References Cited

U.S. PATENT DOCUMENTS

| | | | | |
|---|---|---|---|---|
| 6,954,364 | B2 | 10/2005 | Min et al. | |
| 2002/0180380 | A1 * | 12/2002 | Lin | 315/224 |
| 2007/0040517 | A1 * | 2/2007 | Yu | 315/291 |
| 2007/0090773 | A1 * | 4/2007 | Chung et al. | 315/291 |
| 2007/0126372 | A1 * | 6/2007 | Huang et al. | 315/291 |

* cited by examiner

*Primary Examiner*—Tuyet Vo
(74) *Attorney, Agent, or Firm*—Rabin & Berdo, PC

(57) ABSTRACT

An inverter unit including a converter, a transformer, a feedback circuit and an open lamp lock circuit is provided. The converter receives a drive signal, and outputs a duty voltage signal accordingly. The transformer is selectively coupled with a lamp of a display panel module, and receives the duty voltage signal. When the transformer is coupled with the lamp, the transformer outputs an output voltage to the lamp according to the duty voltage signal to light up the lamp. The feedback circuit receives a feedback signal from the lamp, and outputs a feedback voltage signal accordingly. The open lamp lock circuit is coupled with the feedback circuit, receives a control signal, selectively receives the feedback voltage signal, and disables the drive signal selectively according to the feedback voltage signal and the control signal.

24 Claims, 6 Drawing Sheets

INVERTER AND INVERTER UNIT THEREOF

This application claims the benefit of Taiwan Patent Application Serial No. 095129993, filed Aug. 15, 2006, the subject matter of which is incorporated herein by reference.

BACKGROUND OF THE INVENTION

1. Field of the Invention

The invention relates in general to an inverter unit, and more particularly to an inverter unit using an open lamp lock circuit to determine whether to output a voltage to light up a lamp of a liquid crystal display panel.

2. Description of the Related Art

Before a liquid crystal display panel module leaves the factory, an inverter is used to light up the backlight source and the lamp of the liquid crystal display panel module is tested, such that defective products are detected and product quality is assured. However, as the display panel modules have various sizes and are incorporated with different number of lamps, inverters are used in large amount and large variety as indicated in FIGS. 1A and 1B. FIG. 1A shows a lamp of a display panel module is lit up by a conventional inverter with single-end output. FIG. 1B shows a lamp of a display panel module is lit up by a conventional inverter with dual-end output. The inverter 120 includes an inverter unit 121, and is used to output an output voltage to light up the lamp 111. The inverter 120 is only applicable to the display panel module 110 having only one lamp 111. When the two lamps 131 and 132 of the display panel module 130 are to be lit up, the inverter 140 is used. The inverter 140 has two inverter units 141 and 142, and is used to output two output voltages to light up the lamps 131 and 132, respectively.

When inspecting the display panel module having various sizes or different number of lamps, the inverter is exclusive to a particular display panel module, not only increasing the manufacturing cost of the inverter and the testing cost of the display panel module, but also adding inconvenience to the inspector for having to replace various types of inverters, reducing testing efficiency, and exposing the inspector to the risk of electric shock during inspection.

Therefore, how to develop an inverter which can be easily and safely applied to the display panel module having various sizes or different number of lamps has become an imminent issue to be resolved.

SUMMARY OF THE INVENTION

It is therefore an object of the invention to provide an inverter and an inverter unit. When the inverter unit of the inverter is coupled with a lamp, the inverter unit outputs an output voltage to the lamp to light up the lamp. When the inverter unit of the inverter is not coupled with the lamp, the inverter unit does not output any voltage such that the safety for the operator is assured. The inverter of the invention is applicable to liquid crystal display panel modules having various sizes or different number of lamps, hence reducing testing cost and saving testing time.

The invention achieves the above-identified object by providing an inverter unit including a converter, a transformer, a feedback circuit and an open lock circuit. The converter receives at least a drive signal, and outputs a duty voltage signal accordingly. The transformer is selectively coupled with a lamp of a display panel module, and receives the duty voltage signal. When the transformer is coupled with the lamp, the transformer outputs an output voltage to the lamp according to the duty voltage signal to light up the lamp. The feedback circuit receives a feedback signal from the lamp, and outputs a feedback voltage signal accordingly. The open lamp lock circuit is coupled with the feedback circuit, receives a control signal, selectively receives the feedback voltage signal to detect whether the lamp is coupled, and disables the drive signal selectively according to the feedback voltage signal and the control signal.

The invention achieves another object by providing an inverter including a control unit and at least an inverter unit. The control unit outputs at least a pre-driving signal and a control signal. Each inverter unit is selectively coupled with a lamp of a display panel module, and includes a buffer, a converter, a transformer, a feedback circuit and an open lock circuit. The buffer receives the pre-driving signal, and outputs at least a drive signal accordingly. The converter receives the drive signal, and outputs a duty voltage signal accordingly. The transformer is selectively coupled with the lamp, and receives the duty voltage signal. When the transformer is coupled with the lamp, the transformer outputs an output voltage to the lamp according to the duty voltage signal to light up the lamp. The feedback circuit receives a feedback signal from the lamp, and outputs a feedback voltage signal accordingly. The open lamp lock circuit is coupled with the feedback circuit, receives a control signal, selectively receives the feedback voltage signal to detect whether the lamp is coupled, and disables the drive signal selectively according to the feedback voltage signal and the control signal.

Other objects, features, and advantages of the invention will become apparent from the following detailed description of the preferred but non-limiting embodiments. The following description is made with reference to the accompanying drawings.

DETAILED DESCRIPTION OF THE INVENTION

The inverter of the invention includes at least an inverter unit applicable to the liquid crystal display panel module of various sizes and makes and having different number of lamps. The inverter of the invention is applicable to various types of liquid crystal display panel modules to light up the lamps thereof during testing. As the inverter is applied to test the display panel module, the inverter unit coupled with the lamp outputs an output voltage to light up the lamp, while the inverter unit not coupled with the lamp does not output any voltage lest the operator might accidentally touch high voltage and get electric shock.

Figure 1A:
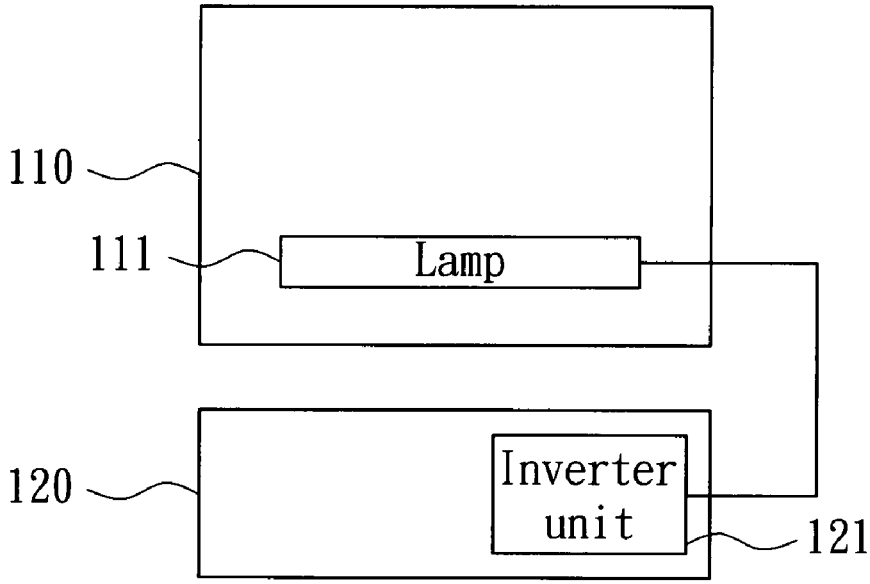
FIG. 1A(RELATED ART)
FIG. 1A shows a lamp of a display panel module is lit up by a conventional inverter with single-end output.
Figure 1B:
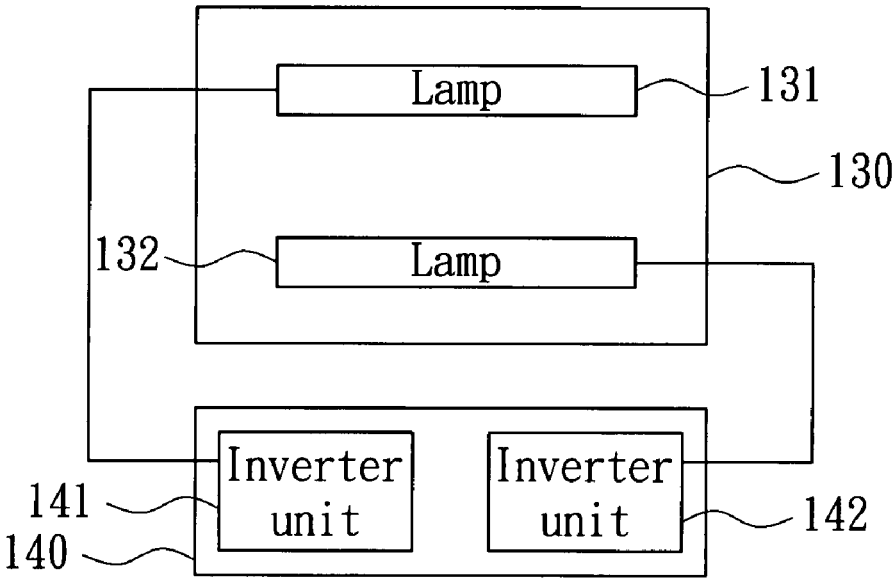
FIG. 1B(RELATED ART)
FIG. 1B shows a lamp of a display panel module is lit up by a conventional inverter with dual-end output.
Figure 2A:
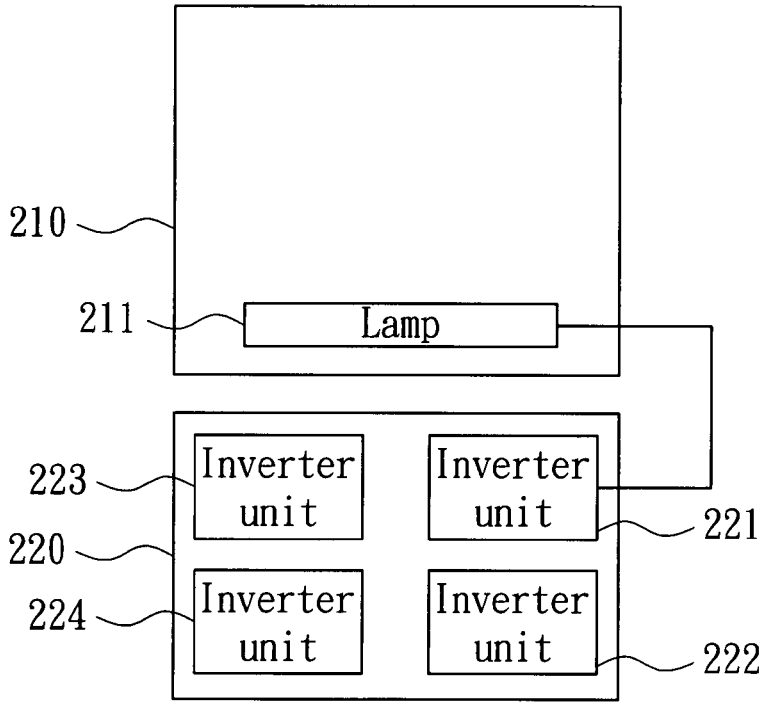
FIGS. 2A to 2C show a display panel module with different number of lamps being lit up by the inverter according to a preferred embodiment of the invention.
Figure 2B:
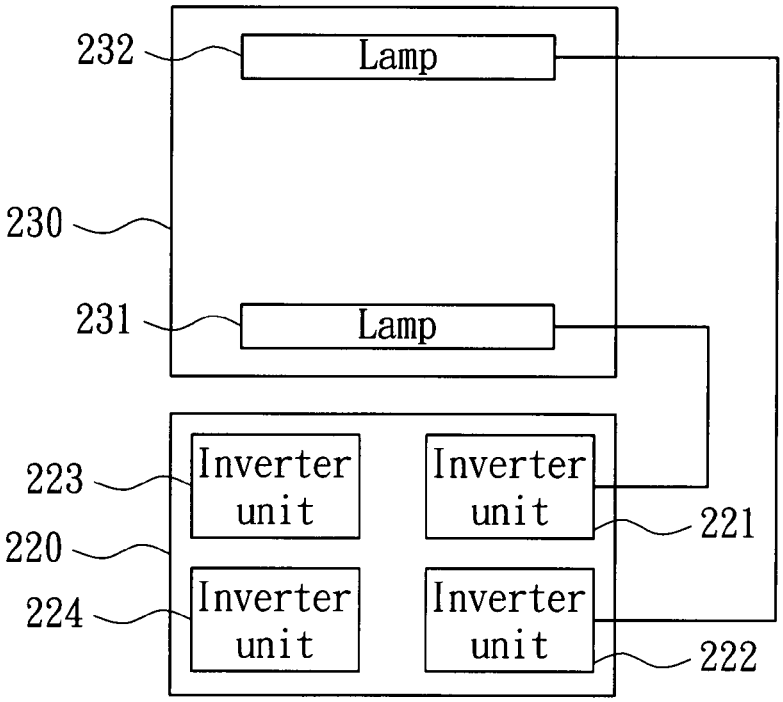
Figure 2C:
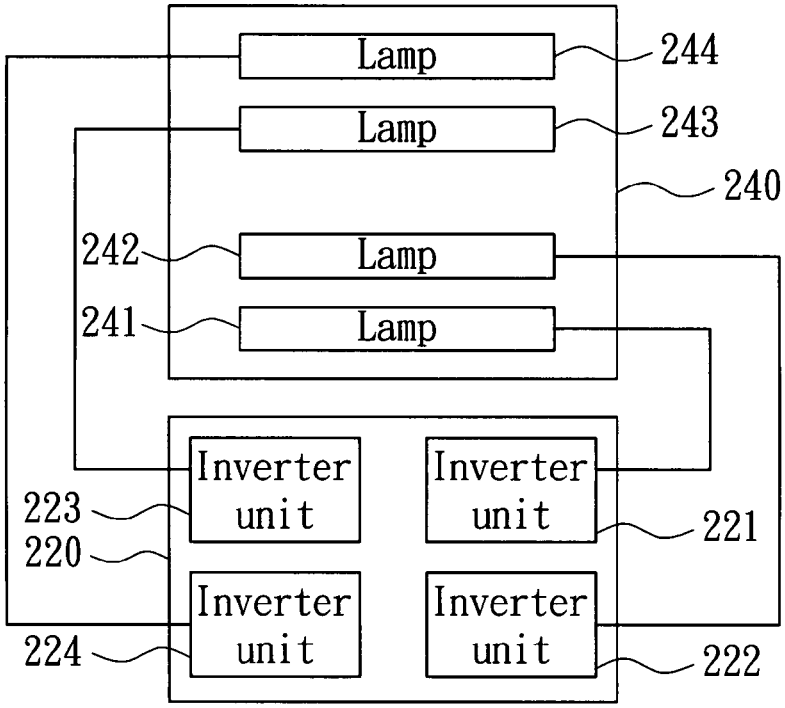

Referring to FIGS. 2A to 2C, a display panel module with different number of lamps is lit up by the inverter according to a preferred embodiment of the invention. The inverter 220 according to the preferred embodiment of the invention is exemplified by having four sets of inverter units 221, 222, 223 and 224. In FIG. 2A, the inverter 220 is used to light up the display panel module 210. As the display panel module 210 only has a lamp 211, only one of the four inverter units of the inverter 220 is used. In FIG. 2A, the inverter unit 221 outputs an output voltage to the lamp 211 to light up the lamp 211, while the inverter units 222, 223 and 224 not coupled with any lamp do not output any voltage. In FIG. 2A, the embodiment is exemplified by outputting an output voltage to the lamp 211 by the inverter unit 221. In practical application, any one of the inverter units 221 to 224 can be used to light up the lamp 211.

Similarly, in FIG. 2B, as the inverter 220 is used to light up the display panel module 230 having two lamps 231 and 232, two of the four inverter units are used to light up the two lamps. In FIG. 2A, the inverter unit 221 and 222 output an output voltage to light up the lamps 231 and 232, respectively, while the inverter units 223 and 224 not coupled with the lamp do not output any voltage. In FIG. 2C, the inverter 220 is used to light up the display panel module 240 having four lamps, so all of the four inverter units 221, 222, 223 and 224 are used to light up the lamps 241, 242, 243 and 244, respectively.

Figure 3:
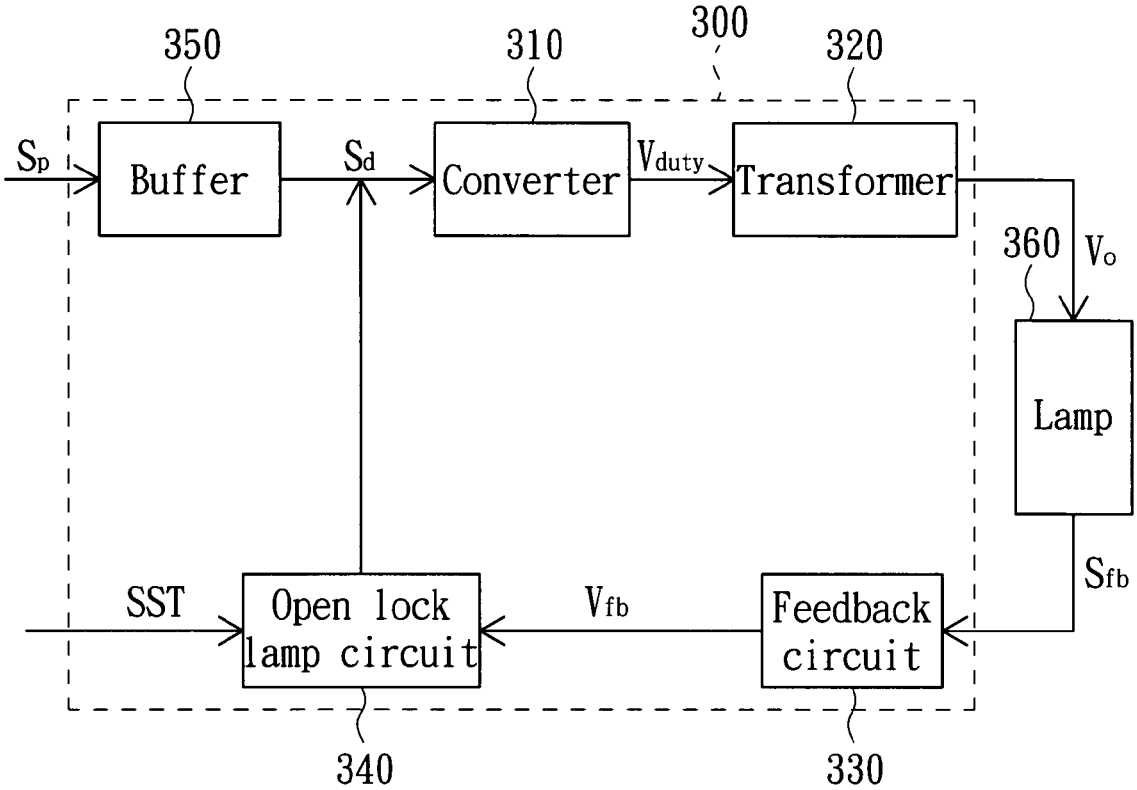
FIG. 3 shows a block diagram of the inverter unit 300 according to a preferred embodiment of the invention.

FIG. 3 shows a block diagram of the inverter unit 300 according to a preferred embodiment of the invention. The inverter units of the inverter of FIGS. 2A to 2C are exemplified by the inverter unit 300 of FIG. 3. The inverter unit 300 includes a converter 310, a transformer 320, a feedback circuit 330 and an open lamp lock circuit 340. When the inverter unit 300 is at an initial state, the converter 310 and the open lamp lock circuit 340 receive an enabling drive signal Sd, for example, a pulse-width modulation (PWM) signal, at the same time. Meanwhile, as the lamp 360 is not lit up and has not outputted out a feedback signal Sfb and a feedback voltage signal Vfb yet, the control signal SST controls the open lamp lock circuit 340 such that the drive signal Sd continues to be outputted to the converter 310. The converter 310, such as the full-bridge converter, the half-bridge converter or the push-pull converter, outputs a duty voltage signal Vduty to the transformer 320 according to the drive signal Sd, and the transformer 320 outputs an output voltage Vo according to the duty voltage signal Vduty.

When the transformer 320 is coupled with the lamp 360, the output voltage Vo lights up the lamp 360. Meanwhile, the lamp 360 outputs a feedback signal Sfb to the feedback circuit 330, and the feedback circuit 330 outputs a feedback voltage signal Vfb to the open lamp lock circuit 340 according to the feedback signal Sfb. The control signal SST controls the open lamp lock circuit 340, such that the drive signal Sd continues to be outputted to the converter 310, and the output voltage Vo continues to be outputted to light up the lamp 360.

When the transformer 320 is not coupled with the lamp 360, the feedback circuit 330 does not receive the feedback signal Sfb, and does not output the feedback voltage signal Vfb to the open lamp lock circuit 340. Meanwhile, the control signal SST controls the open lamp lock circuit 340 and disables the drive signal Sd, such that the converter 310 no more outputs the duty voltage signal Vduty, and the transformer 320 no more outputs the output voltage Vo either.

When the transformer 320 is coupled with the lamp 360, the feedback voltage signal Vfb is used to detect whether the inverter unit 300 lights up the lamp normally. If the lamp is not lit up normally, for example, the operator accidentally touches the output end of the transformer 320, or the lamp 360 is broken, the control signal SST controls the open lamp lock circuit 340 according to the feedback voltage signal Vfb and disables the drive signal Sd for stopping the transformer 320 from outputting the output voltage Vo.

It is noted from the above disclosure that no voltage is outputted when the inverter unit of the inverter according to the preferred embodiment of the invention is coupled with the lamp or when the lamp is lit up normally, hence the safety for the operator is assured.

Besides, the inverter unit 300 can further include a buffer 350, e.g. an amplifier, for receiving and amplifying a pre-driving signal Sp into a drive signal Sd.

Figure 4A:
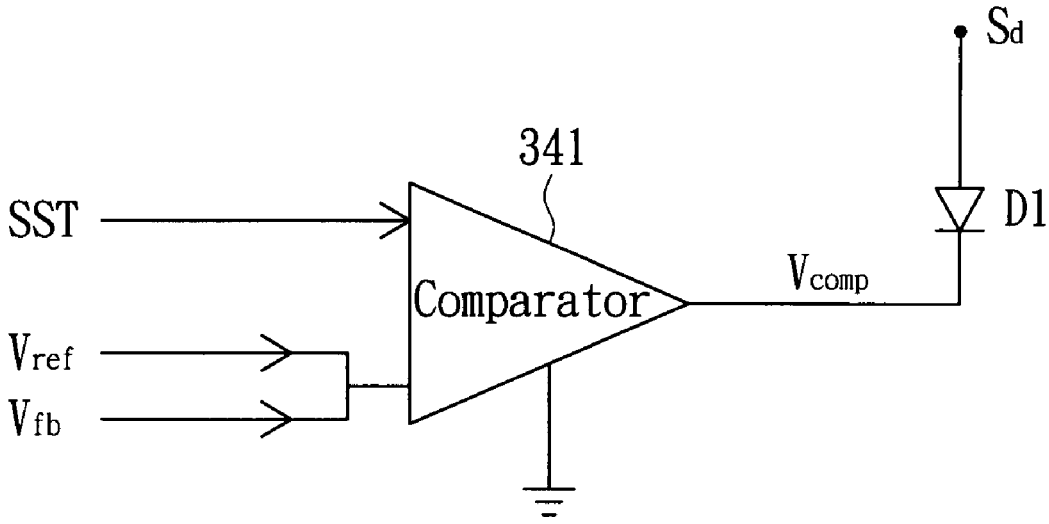
FIG. 4A shows the open lamp lock circuit 340 of the inverter unit 300 according to a preferred embodiment of the invention.

FIG. 4A shows the open lamp lock circuit 340 of the inverter unit 300 according to the preferred embodiment of the invention. The open lamp lock circuit 340 includes a comparator 341 and a first diode D1. The comparator 341 receives the control signal SST and either of a reference voltage Vref and the feedback voltage signal Vfb. The output end of the comparator 341 is coupled with the negative electrode of the first diode D1, and the positive electrode of the first diode D1 also receives the drive signal Sd.

When the inverter unit 300 is at an initial state, the comparator 341 has not received the feedback voltage signal Vfb yet. The comparator 341 compares the control signal SST with the reference voltage signal Vref, and outputs a comparison-outcome signal Vcomp accordingly. The comparison-outcome signal Vcomp turns off the first diode D1 and transmits the drive signal Sd to the converter 310 for enabling the transformer 320 to output the output voltage Vo.

When the inverter unit 300 is coupled with the lamp 360, the feedback voltage signal Vfb is transmitted to the comparator 341 from the feedback circuit 330. The comparator 341 compares the control signal SST with the feedback voltage signal Vfb, and outputs the comparison-outcome signal Vcomp accordingly. The comparison-outcome signal Vcomp enables the first diode D1 to maintain off such that the drive signal Sd continues to be transmitted to the converter 310 for enabling the transformer 320 to continue providing the output voltage Vo to light up the lamp 360.

When the inverter unit 300 is not coupled with the lamp 360, no feedback voltage signal Vfb is transmitted to the comparator 341. The comparator 341 compares the control signal SST with the reference voltage signal Vref, and outputs the comparison-outcome signal Vcomp accordingly. The comparison-outcome signal Vcomp turns on the first diode D1, such that the first diode D1 is coupled with the ground end via the inside of the comparator 341, the drive signal Sd is disabled, and the transformer 320 stops outputting the output voltage Vo.

Figure 4B:
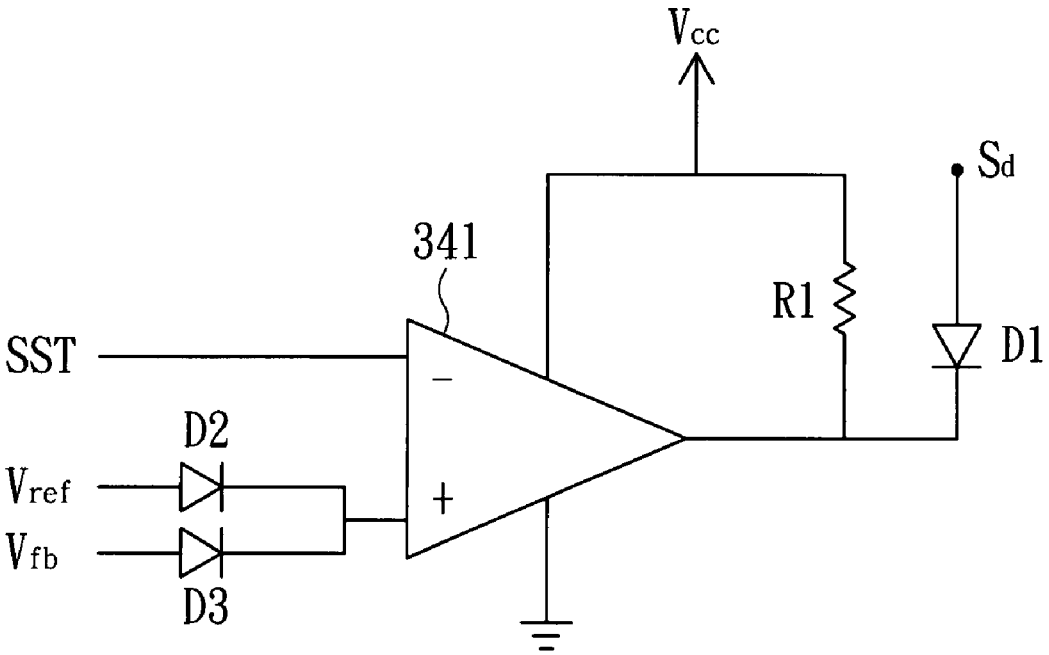
FIGS. 4B, 4C and 4D show various embodiments of the open lamp lock circuit 340 of FIG. 4A.

FIG. 4B shows an embodiment of the open lamp lock circuit 340 of FIG. 4A. The control signal SST is inputted to the negative input end of the comparator 341, and a reference voltage signal Vref and a feedback voltage signal Vfb are inputted to the positive input end of the comparator 341 via a second diode D2 and a third diode D3, respectively. The first resistor R1 is crossly connected between a voltage source Vcc and the output end of the comparator. The voltage source Vcc also provides power to the comparator 341.

When the inverter unit 300 is at an initial state, the comparator 341 receives the control signal SST and the reference voltage signal Vref. Meanwhile, the control signal SST is at a first level lower than the level of the reference voltage signal Vref, such that the output end of the comparator 341 is coupled with the voltage source Vcc via the first resistor R1. The level of the voltage source Vcc is higher than the drive signal Sd. Thus, the first diode D1 is turned off, and the drive signal Sd is transmitted to the converter 310.

The control signal SST is boosted to a second level after a period of time. When the inverter unit 300 is coupled with the lamp 360, the feedback voltage signal Vfb is outputted to the third diode D3. As the level of the feedback voltage signal Vfb is higher than the level of the reference voltage signal Vref, the comparator 341 receives the control signal SST and the feedback voltage signal Vfb. The level of the feedback voltage signal Vfb is higher than the second level of the control signal SST, such that the output end of the comparator 341 is coupled with the voltage source Vcc via the first resistor R1, the first diode D1 maintains off, and the drive signal Vd is transmitted to the converter 310 to light up the lamp 360.

If abnormality occurs when the inverter unit 300 is coupled with the lamp 360, for example, the operator accidentally touches the output end of the transformer 320, the feedback signal Sfb transmitted from the lamp 360 reduces the level of the feedback voltage signal Vfb transmitted from the feedback circuit 330. When the level of the feedback voltage signal Vfb is lower than the second level of the control signal SST, the output end of the comparator 341 will be coupled with the ground end via the inside of the comparator 341. The drive signal Sd is transmitted to the ground end via the first diode D1 and becomes disabled for stopping the transformer 320 from outputting the output voltage Vo.

When the inverter unit 300 is not coupled with the lamp 360, not any feedback voltage signal Vfb is transmitted to the comparator 341. The comparator 341 compares the control signal SST with the reference voltage signal Vref. The second level of the control signal SST is higher than the level of the reference voltage signal Vref. Likewise, the output end of the comparator 341 is coupled with the ground end via the inside of the comparator 341, and the drive signal Sd becomes disabled for stopping the transformer 320 from outputting the output voltage Vo.

Figure 4C:
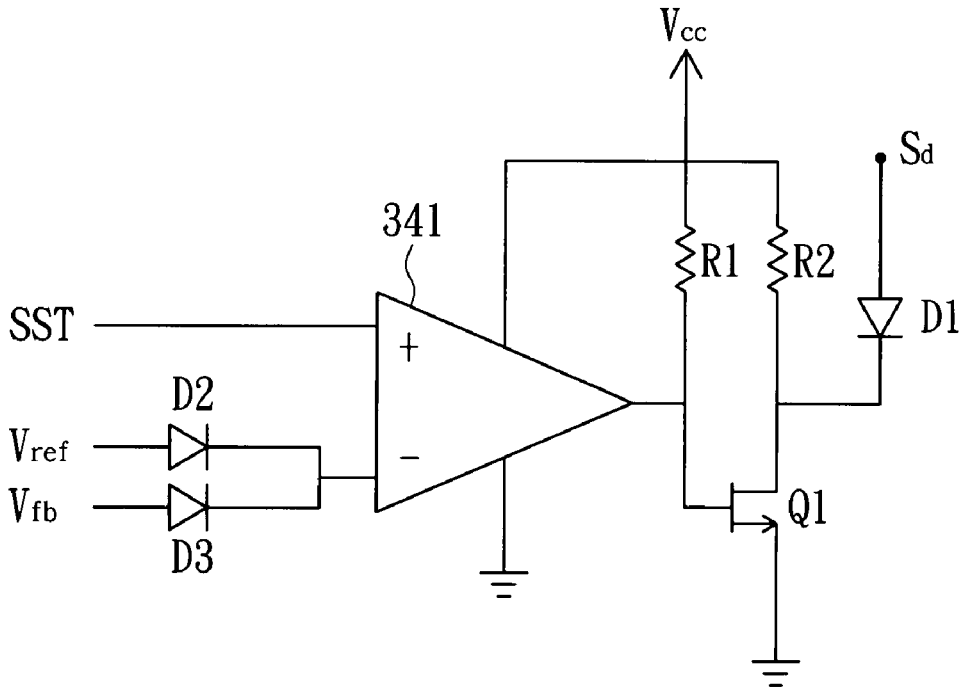

FIG. 4C shows another embodiment of the open lamp lock circuit 340 of FIG. 4A. In FIG. 4C, the control signal SST is inputted to the positive input end of the comparator 341, while the reference voltage signal Vref and the feedback voltage signal Vfb are transmitted to the negative input end of the comparator 341 via the second diode D2 and the third diode D3, respectively. Other features in FIG. 4C is the same as in FIG. 4B. The output end of the comparator 341 is further coupled with a transistor Q1. The control end of the transistor Q1 is coupled with the output end of the comparator 341, the first end of the transistor Q1 is coupled with the voltage source Vcc via a second resistor R2, and the second end of the transistor Q1 is coupled with the ground end.

When the inverter unit 300 is at an initial state, the comparator 341 receives the control signal SST and the reference voltage signal Vref. The control signal SST is at a first level lower than the level of the reference voltage signal Vref, such that the output end of the comparator 341 is coupled with the ground end via the inside of the comparator 341, and the transistor Q1 is turned off. The voltage source Vcc is coupled with first negative electrode of the diode D1 via the second resistor R2, such that the first diode D1 is turned off and the drive signal Sd is transmitted to the converter 310.

The control signal SST is boosted to the second level after a period of time. When the inverter unit 300 is coupled with the lamp 360, the feedback voltage signal Vfb is outputted to the third diode D3. The comparator 341 compares the control signal SST with the feedback voltage signal Vfb. The level of the feedback voltage signal Vfb is higher than the second level of the control signal SST, such that the output end of the comparator 341 is coupled with the ground end via the inside of the comparator 341, both the transistor Q1 and the first diode D1 maintain off, and the drive signal Sd is transmitted to the converter 310 to light up the lamp 360.

When the inverter unit 300 is not coupled with the lamp 360, the comparator 341 compares the control signal SST with the reference voltage signal Vref. The second level of the control signal SST is higher than the level of the reference voltage signal Vref, such that the transistor Q1 is turned on, the drive signal Sd becomes disabled, and the transformer 320 stops outputting the output voltage Vo.

Figure 4D:
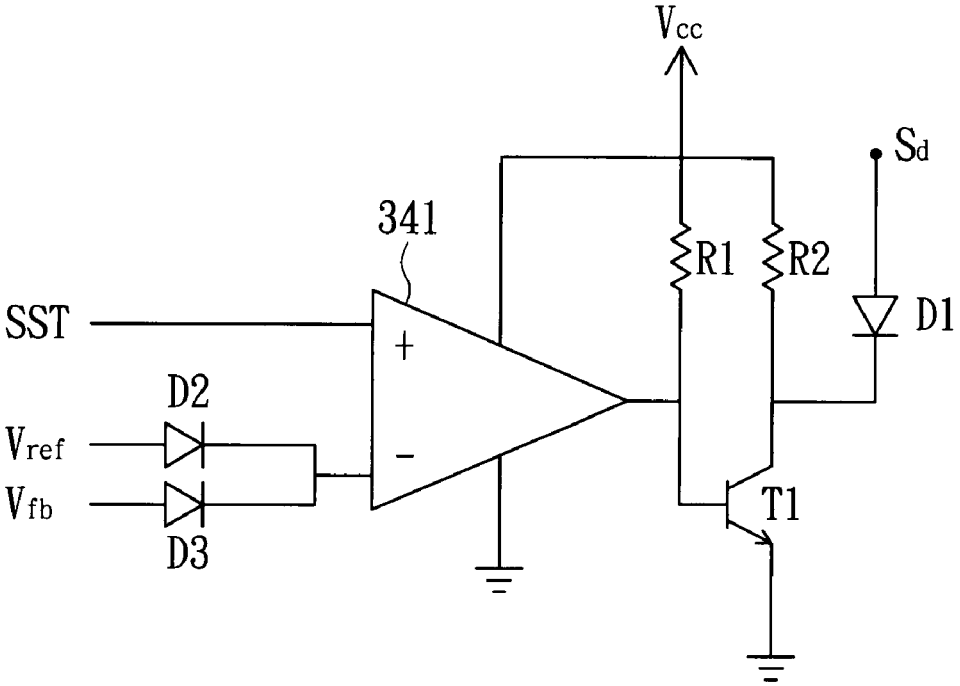

In FIG. 4C, the transistor Q1 is exemplified by an N-type metal-oxide semiconductor (NMOS) transistor. However, in practical application, a P-type metal-oxide semiconductor (PMOS) transistor, an NPN-type or a PNP-type bi-polar junction transistor will do. In another embodiment of the open lamp lock circuit 340 as indicated in FIG. 4D, the NMOS transistor Q1 of FIG. 4C is replaced by an NPN-type bi-polar junction transistor T1.

In above disclosure, the inverter unit 300 is exemplified by generating an output voltage Vo by one drive signal Sd. In practical application, the buffer 350 of the inverter unit 300 can receive several pre-driving signals Sp, and generate several drive signals Sd corresponding to the pre-driving signals Sp, and adopt several first diodes D1 corresponding to the drive signals Sd.

Figure 5:
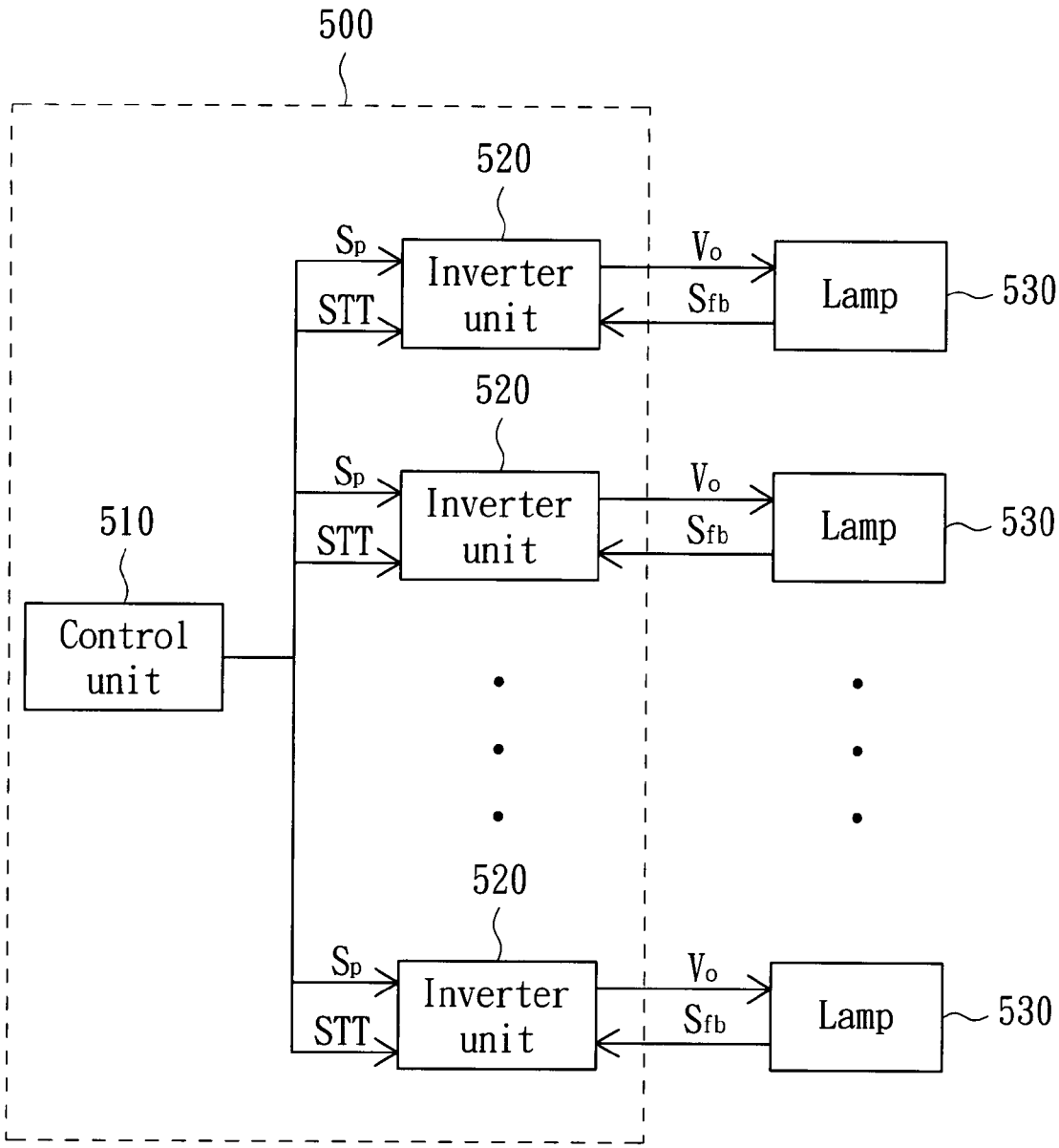
FIG. 5 shows a block diagram of the inverter according to a preferred embodiment of the invention.

FIG. 5 shows a block diagram of the inverter according to a preferred embodiment of the invention. The inverter 500 according to the preferred embodiment of the invention includes a control unit 510 and at least an inverter unit 520. The control unit 510 respectively outputs a pre-driving signal Sp and a control signal SST to each inverter unit 520 to light up the lamp 530 corresponding to the inverter unit 520. For each inverter unit 520, if the inverter unit 520 is coupled with a lamp 530, the inverter unit 520 outputs the output voltage Vo to the lamp 530 to light up the lamp 530. Meanwhile, the lamp 530 outputs a feedback signal Sfb to the inverter unit 520 to determine whether the inverter unit 520 will output an output voltage Vo. If the inverter unit 520 is not coupled with the lamp 530, the inverter unit 520 does not output any voltage. The inverter unit 520 includes a buffer, a converter, a transformer, a feedback circuit and an open lock circuit. The buffer receives a pre-driving signal Sp, and outputs a drive signal according to the pre-driving signal Sp. Other functions of the circuit are the same with the inverter unit of FIG. 3, and are not repeated here.

The inverter FIGS. 2A to 2C according to the preferred embodiment of the invention is exemplified by four inverter units. In practical application, the number of inverter units used in the inverter is determined according to actual needs. Provided that the number of inverter unit is enough, the inverter of the invention is able to light up the liquid crystal display panel module having different number of lamps or different sizes, reducing the replacement of inverters and avoiding the risk of accidentally touching the high voltage.

The inverter of the invention unit determines the output voltage according to the feedback signal transmitted from the lamp, such that the inverter unit does not output any voltage to assure safety for the operator when the inverter is not coupled with the lamp or abnormality occurs during the process of lighting up the lamp. In comparison, a conventional inverter having several inverter units will output high output voltage regardless whether the inverter is coupled with the lamp or not. In such circumstance, the operator is exposed to the risk of touching a high voltage accidentally.

The inverter of the invention adopting the above inverter units is applicable to the liquid crystal display panel module having different number of lamps or different sizes, and the number of inverter unit can be augmented according to actual needs. In comparison, the conventional inverter employs various inverters to go with the liquid crystal display panel module having different number of lamps or different sizes, increasing not only testing time and testing cost but also the risk of electric shock by the operator. Thus, the inverter of the invention not only simplifies the operation of the inverter and saves testing cost, but also improves manufacturing efficiency and safety for operator.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An inverter unit for use in a display panel module including a lamp, comprising:

a converter for receiving at least one drive signal and outputting a duty voltage signal accordingly;

a transformer, selectively coupled with the lamp, for receiving the duty voltage signal, wherein when the transformer is coupled with the lamp, the transformer outputs an output voltage to the lamp according to the duty voltage signal to light up the lamp;

a feedback circuit for receiving a feedback signal from the lamp and outputting a feedback voltage signal accordingly; and an open lamp lock circuit, electrically coupled with the feedback circuit, for receiving a control signal and selectively receiving the feedback voltage signal to detect whether the lamp is coupled, and for selectively disabling the at least one drive signal according to the feedback voltage signal and the control signal, wherein the open lamp lock circuit comprises:

at least a diode having a negative electrode and a positive electrode for receiving the at least one drive signal; and a comparator having an input end and an output end electrically coupled with the negative electrode of the at least one diode, wherein the input end of the comparator receives the control signal and either of the feedback voltage signal and a reference voltage signal, and the comparator outputs a comparison-outcome signal accordingly;

wherein when the inverter unit is at an initial state, the comparison-outcome signal turns off the at least one diode for the at least one drive signal to be transmitted to the converter.

2. The inverter unit according to claim 1, wherein when the transformer is not coupled with the lamp, the control signal controls the open lamp lock circuit to disable the at least one drive signal for stopping the transformer from outputting the output voltage.

3. The inverter unit according to claim 1, wherein when the transformer is coupled with the lamp, the open lamp lock circuit determines whether the lamp is lighted up correctly or not according to the feedback voltage signal, and if not, the open lamp lock circuit disables the at least one drive signal for stopping the transformer from outputting the output voltage to the lamp.

4. The inverter unit according to claim 1, wherein the inverter unit further comprises a buffer for receiving at least one pre-driving signal and outputting the at least one drive signal accordingly.

5. The inverter unit according to claim 1, wherein the open lamp lock circuit further comprises a transistor having a control end electrically coupled with the output end of the comparator, and wherein the first end of the transistor is coupled with the negative electrode of the diode, and the second end of the transistor is coupled with the ground end.

6. The inverter unit according to claim 5, wherein the transistor is an N-type or a P-type metal-oxide semiconductor transistor, a PNP or an NPN bi-polar junction transistor.

7. The inverter unit according to claim 1, wherein when the inverter unit is at an initial state, the control signal is at a first level, the control signal is boosted to a second level after a period of time, the level of the reference voltage signal is higher than the first level but lower than the second level, and the level of the feedback voltage signal is higher than the second level.

8. The inverter unit according to claim 7, wherein when the inverter unit is at the initial state, the comparator compares the control signal with the reference voltage signal, and the comparison-outcome signal is at a third level higher than the level of the drive signal for turning off the diode.

9. The inverter unit according to claim 7, wherein when the transformer is coupled with the lamp and the control signal is at the second level, the comparator compares the control signal with the feedback voltage signal, and the comparison-outcome signal is at the third level for turning off the diode.

10. The inverter unit according to claim 7, wherein when the transformer is coupled with the lamp and the control signal is at the second level, the comparator compares the control signal with the feedback voltage signal, and if the inverter unit fails to light up the lamp normally, the level of the feedback voltage signal is shifted to be smaller than the second level for turning on the diode for stopping the transformer from outputting the output voltage.

11. The inverter unit according to claim 7, wherein when the transformer is not coupled with the lamp and the control signal is at the second level, the comparator compares the control signal with the reference voltage signal, and the comparison-outcome signal is at a fourth level for turning on the diode.

12. An inverter for use in a display panel module including a lamp, comprising:

a control unit for outputting at least one pre-driving signal and a control signal;

at least one inverter unit, each being selectively coupled with the lamp, comprising:

a buffer for receiving the at least one pre-driving signal and outputting at least one drive signal accordingly;

a converter for receiving the at least one drive signal and outputting a duty voltage signal accordingly;

a transformer, selectively coupled with the lamp, for receiving the duty voltage signal, wherein when the transformer is coupled with the lamp, the transformer outputs an output voltage to the lamp according to the duty voltage signal to light up the lamp;

a feedback circuit for receiving a feedback signal from the lamp and outputting a feedback voltage signal accordingly; and an open lamp lock circuit, electrically coupled with the feedback circuit, for receiving a control signal and selectively receiving the feedback voltage signal to detect whether the lamp is coupled, and for selectively disabling the at least one drive signal according to the feedback voltage signal and the control signal, wherein the open lamp lock circuit comprises:

at least a diode having a negative electrode and a positive electrode for receiving the at least one drive signal; and a comparator having an input end and an output end electrically coupled with the negative electrode of the at least one diode, wherein the input end of the comparator receives the control signal and either of the feedback voltage signal and a reference voltage signal, and the comparator outputs a comparison-outcome signal accordingly;

wherein when the inverter unit is at an initial state, the comparison-outcome signal turns off the at least one diode for the at least one drive signal to be transmitted to the converter.

13. The inverter according to claim 12, wherein for each of the at least one inverter unit, when the transformer of the inverter unit is not coupled with the lamp, the control signal controls the open lamp lock circuit to disable the at least one drive signal for stopping the transformer from outputting the output voltage.

14. The inverter according to claim 12, wherein for each of the at least one inverter unit, the open lamp lock circuit determines whether the lamp is lighted up correctly or not according to the feedback voltage signal, and if not, the open lamp lock circuit disables the at least one drive signal for stopping the transformer from outputting the output voltage to the lamp.

15. An open lamp lock circuit applied in an inverter unit, the inverter unit driving a lamp according to at least one drive signal and a control signal, the lamp outputting a feedback voltage signal, the open lamp lock circuit comprising:

at least a diode having a negative electrode and a positive electrode for receiving the at least one drive signal; and a comparator having an input end and an output end electrically coupled with the negative electrode of the at least one diode, wherein the input end of the comparator receives the control signal and either of the feedback voltage signal and a reference voltage signal, and the comparator outputs a comparison-outcome signal accordingly;

wherein when the inverter unit is at an initial state, the comparison-outcome signal turns off the at least one diode and the inverter unit lights up the lamp according to the at least one drive signal.

16. The open lamp lock circuit according to claim 15, wherein when the inverter unit is not coupled with the lamp, the control signal controls the open lamp lock circuit to disable the at least one drive signal for stopping the inverter unit from lighting up the lamp.

17. The open lamp lock circuit according to claim 15, wherein when the inverter unit is coupled with the lamp, the open lamp lock circuit determines whether the lamp is lighted up correctly or not according to the feedback voltage signal, and if not, the open lamp lock circuit disables the at least one drive signal for stopping the inverter unit from lighting up the lamp.

18. The open lamp lock circuit according to claim 15, wherein the open lamp lock circuit further comprises a transistor having a control end electrically coupled with the output end of the comparator, the first end of the transistor is coupled with the negative electrode of the diode, and the second end of the transistor is coupled with the ground end.

19. The open lamp lock circuit according to claim 18, wherein the transistor is an N-type or a P-type metal-oxide semiconductor transistor, a PNP or an NPN bi-polar junction transistor.

20. The open lamp lock circuit according to claim 15, wherein when the inverter unit is at an initial state, the control signal is at a first level, the control signal is boosted to a second level after a period of time, the level of the reference voltage signal is higher than the first level but lower than the second level, and the level of the feedback voltage signal is higher than the second level.

21. The open lamp lock circuit according to claim 20, wherein when the inverter unit is at the initial state, the comparator compares the control signal with the reference voltage signal, and the comparison-outcome signal is at a third level higher than the level of the drive signal for turning off the diode.

22. The open lamp lock circuit according to claim 20, wherein when the inverter unit is coupled with the lamp and the control signal is at the second level, the comparator compares the control signal with the feedback voltage signal, and the comparison-outcome signal is at the third level for turning off the diode.

23. The open lamp lock circuit according to claim 20, wherein when the inverter unit is coupled with the lamp and the control signal is at the second level, the comparator compares the control signal with the feedback voltage signal, and if the inverter unit fails to light up the lamp normally, the level of the feedback voltage signal is shifted to be smaller than the second level for turning on the diode for stopping the inverting unit from lighting up the lamp.

24. The open lamp lock circuit according to claim 20, wherein when the inverter unit is not coupled with the lamp and the control signal is at the second level, the comparator compares the control signal with the reference voltage signal, and the comparison-outcome signal is at a fourth level for turning on the diode.

* * * * *